US005875674A

United States Patent [19]

Ayers, Jr.

[11] Patent Number: 5,875,674

[45] Date of Patent: Mar. 2, 1999

[54] BUCKING TOOL

[75] Inventor: Richard D. Ayers, Jr., New Haven, Ky.

[73] Assignee: Carolyn F. Wiley, Louisville, Ky.

[21] Appl. No.: 937,491

[22] Filed: Sep. 25, 1997

[51] Int. Cl.[6] ..... B21D 31/06

[52] U.S. Cl. ..... 72/477; 72/476

[58] Field of Search ..... 72/477, 476

[56] References Cited

U.S. PATENT DOCUMENTS

| | | | |
|---|---|---|---|
| 1,373,606 | 4/1921 | Elias | 72/479 |
| 1,414,095 | 4/1922 | Power | 72/476 |
| 1,477,579 | 12/1923 | Matonick | 72/477 |
| 1,491,468 | 4/1924 | Dlesk | 72/477 |
| 1,746,077 | 2/1930 | Ferguson | 72/477 |
| 2,512,532 | 6/1950 | Sargent et al. | 78/53.5 |
| 3,478,567 | 11/1969 | Galutia | 72/457 |
| 4,398,411 | 8/1983 | Emmerich | 72/482 |
| 5,269,381 | 12/1993 | Oscarsson | 173/162.2 |

*Primary Examiner*—David B. Jones
*Attorney, Agent, or Firm*—Henderson & Sturm

[57] ABSTRACT

An improved bucking tool construction 10 including a generally L-shaped main tool body unit 11 having opposite ends 22, 23, and a pair of replaceable impact surface units 12 removably disposed on the opposite ends 22, 23 of the tool body unit 11. The tool body unit 11 is fabricated with a material 21 which is softer than the material 32 from which the impact surface units 12 are fabricated.

21 Claims, 1 Drawing Sheet

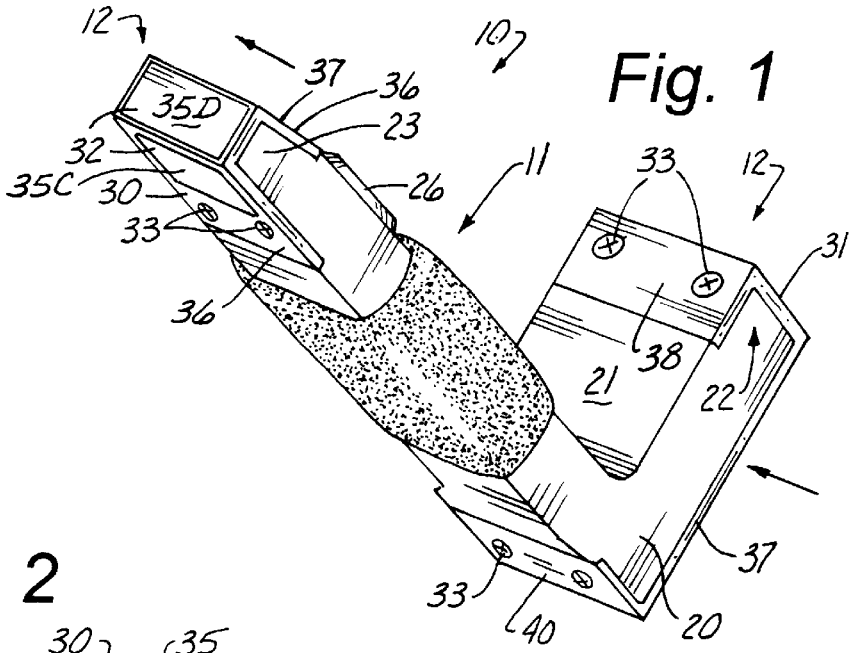
Fig. 1
Fig. 2
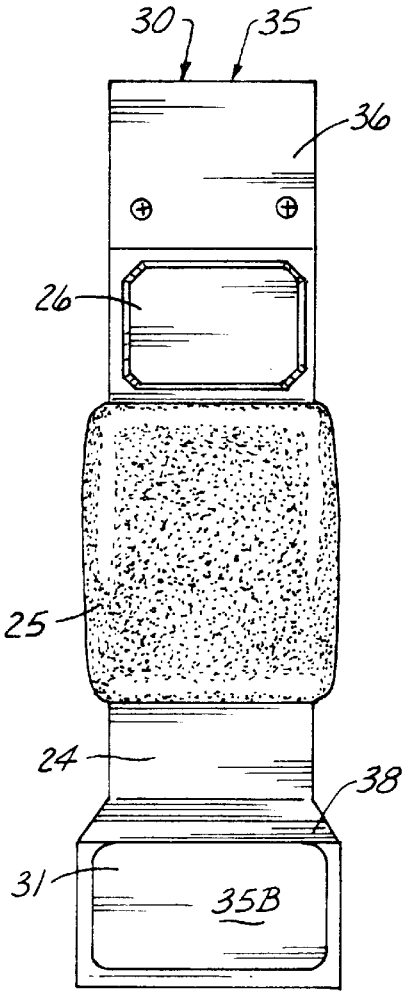
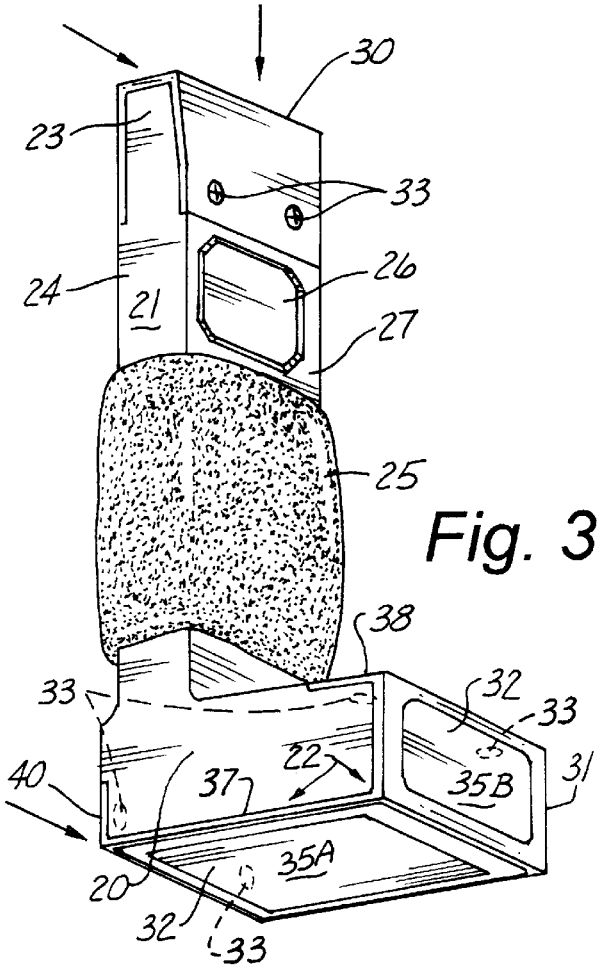
Fig. 3

BUCKING TOOL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of bucking tools in general and, in particular to a rivet bucking tool that has replaceable impact faces.

2. Description of Related Art

As can be seen by reference to the following U.S. Pat. Nos. 2,512,532; 3,478,567; 4,398,411; and 5,269,381, the prior art is replete with myriad and diverse rivet bucking devices.

While all of the aforementioned prior art constructions are more than adequate for the basic purpose and function for which they have been specifically designed, they are uniformly deficient with respect to their failure to provide a simple, efficient, and practical way of providing an economical hand held bucking tool to facilitate the bucking of rivets, particularly for securing the sheet metal of a trailer, or the like.

Up until the present time, no one has developed a low cost basic hand held bucking tool. Instead, most people have relied upon costly and/or complex tool constructions which are not cost effective for either professional or casual usage or have improvised with scrap material available, which often results in loss of quality uniformity in bucking rivets and/or compromises the safety of the technician.

As a consequence of the foregoing situation, there has existed a longstanding need for a new and improved manual bucking tool that is simple, economical and safe to use, yet is also provided with high quality impact receiving and transmitting elements, and the provision of such a construction is a stated objective of the present invention.

BRIEF SUMMARY OF THE INVENTION

Briefly stated, the improved bucking tool construction that forms the basis of the present invention comprises in general, a main tool body unit including a generally L-shaped tool member fabricated from casted stainless steel or casted carbon steel, and a pair of impact surface units including contoured cap members fabricated from hardened tool steel.

As will be explained in greater detail further on in the specification, the opposite ends of the tool member are contoured or provided with recesses which are dimensioned to slideably receive the hardened tool steel cap members so as to provide a relatively low cost, yet effective and safe manual bucking tool.

In addition, one end of the generally L-shaped tool member forms a main bucking foot element for bucking post and roof rivets. The other end of the L-shaped tool member forms a main bucking head element that is used for most other rivet bucking operations. Furthermore, the elongated leg portion of the tool member is provided with a cushioned hand grip element, and a lever element molded onto the inboard face of the leg portion of the tool member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view looking down on the improved bucking tool construction that forms the basis of the present invention;

FIG. 2 is a front view of the tool construction; and

FIG. 3 is a perspective view looking up at the tool construction.

DETAILED DESCRIPTION OF THE INVENTION

As can be seen by reference to the drawings and, in particular to FIG. 1, the bucking tool construction that forms the basis of the present invention is designated generally by the reference number 10. The tool construction 10 comprises in general a main tool body unit 11 and a pair of replaceable impact surface units 12 attached to the opposite ends of the main tool body unit 11. These units will now be described in seriatim fashion.

As can best be seen by reference to FIGS. 1 and 3, the main tool body unit 11 comprises a generally L-shaped tool member 20 fabricated from casted material 21 such as stainless steel, conventional carbon steel, or the like.

In addition, one end of the tool member 20 forms an enlarged main bucking foot element 22 and the other end of the tool member forms a main bucking head element 23, which tapers slightly from the lever element 26 to the end of the bucking head. The elongated leg portion 24 of the tool member 20 is provided with a cushioned handle element 25 and a lever element 26 is disposed on the inboard surface 27 of the leg portion 24 intermediate the handle element 25 and the end of the bucking head element 23.

Still referring to FIGS. 1 and 3, it can be seen that the pair of replaceable impact surface units 12 comprise a first generally U-shaped impact member 30 dimensioned to slideably engage the main bucking head element 23 in either a horizontal or vertical direction as indicated by the directional arrows, and a second generally C-shaped impact member 31 dimensioned to slideably engage the main bucking foot element 22 in the horizontal direction wherein both of the impact members 30 and 31 are fabricated from hard tempered tool steel 32.

As shown in FIGS. 1 and 3, each of the impact members 30 and 31 are fixedly secured to the bucking head member 23 and bucking foot member 22 via a plurality of fastening elements 33. Each of the impact members 30 and 31 is provided with dual impact faces designated generally as 35A, 35B on bucking foot member 31 and 35C, 35D on bucking head member 30, wherein each of the dual impact faces are oriented generally perpendicular to one another.

As can be seen by reference to FIGS. 1 and 3, the first impact member 30 comprises a dual impact face 35C and 35D flanked by a pair of identical mounting panels 36 provided with apertures (not shown) dimensioned to receive the fastening elements 33. In addition, one or more of the sides of the first impact member 30 may be provided with a lip portion 37 which will act as a lateral stop element and/or guide for installing and replacing the first impact member 30 on the bucking head member 23.

Returning once more to FIGS. 1 and 3, it can be seen that the second impact member 31 comprises dual impact faces 35A, 35B having an upper mounting panel 38 and a real mounting panel 40. The rear 40 and upper 38 mounting panels are provided with apertures (not shown) dimensioned to receive the fastening elements 33 for securing the second impact member 31 to the bucking foot member 22. Furthermore, at least one of the sides of the second impact member 31 may also be provided with a lip portion 37 which will act as a lateral stop element for installing and replacing the second impact member 31 on the bucking foot member 22.

Turning now to FIGS. 1, 2 and 3, it can be seen that the lever element 26 comprises an inclined plane molded as part of the main tool body unit 11 between the cushioned handle element 25 and the tapered U-shaped impact member 30. The lever 26 is used as a fulcrum in the trough of a top rail, resting on the bottom lip of the trough while impact plate 35C is used to apply uniform pressure to the bottom of a rivet as it is being bucked.

In use, a trailer technician would grasp the handle element 25 (with the bucking foot member 22 down), pressing the impact plate 35A on the second impact member 31 covering the bucking foot 22 against the rear of a rivet to buck the chosen rivet (post or wide top rail trough) into place. Then, should the technician need to buck a rivet in a narrow top rail trough, he would use the opposite end of the tool, with bucking foot element 22 down and used as a handle while placing the impact face 35C on the first impact member 30 covering the bucking head 23 against the rear of the rivet, using the lever 26 as a fulcrum resting on the bottom lip of the trough to buck the chosen rivet into place. Then, should the technician need to buck a rivet at the bottom of the post, he would place impact face 35D on first impact member 30 (with bucking foot member 22 up and again used as a handle) against the rear of the rivet to buck the chosen rivet into place. In addition, the lever element 26 may be used to apply pressure to the bucking head while riveting in a confined area.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. An improved bucking tool construction comprising a generally L-shaped main tool body unit having opposite ends; and a pair of replaceable impact surface units removably mounted on the opposite ends of the main tool body unit; wherein each of the impact members are provided with dual impact faces.

2. The bucking tool construction as in claim 1 wherein said main tool body unit is fabricated from casted steel and wherein said pair of replaceable impact surface units are fabricated from tempered tool steel.

3. The bucking tool construction as in claim 1 wherein said main tool body unit includes a tool member having one end defining an enlarged bucking foot member and having the other end defining a bucking head member.

4. The bucking tool construction as in claim 3 wherein the bucking head member is formed on the leg portion of the L-shaped main tool body unit.

5. The bucking tool construction as in claim 4 wherein said leg portion is provided with a padded handle element.

6. The bucking tool construction as in claim 5 wherein said leg portion is further provided with a lever element intermediate the handle element and said bucking head member.

7. The bucking tool construction as in claim 4 wherein said pair of replaceable impact surface units includes a first generally U-shaped impact member dimensioned to be received on at least one of the opposite ends of said main tool body unit.

8. The bucking tool construction as in claim 7 further including a second generally C-shaped impact member dimensioned to be received on at least one of the opposite ends of said main tool body unit.

9. The bucking tool construction as in claim 8 wherein said first and second impact members include an impact plate.

10. The bucking tool construction as in claim 9 wherein said first impact member includes a pair of mounting panels disposed on opposite sides of said impact plate.

11. The bucking tool construction as in claim 9 wherein said second impact member includes a top mounting panel and a rear mounting panel.

12. The bucking tool as in claim 7 wherein said first impact member is provided with a lip portion dimensioned to engage the bucking head member.

13. The bucking tool as in claim 8 wherein said second impact member is provided with a lip portion dimensioned to engage the bucking foot member.

14. The bucking tool as in claim 1 wherein said dual impact faces are aligned generally perpendicular to one another.

15. An improved bucking tool construction comprising:

a generally L-shaped main tool body unit having opposite ends and includes a tool member having one end defining an enlarged bucking foot member and having the other end defining a bucking head member which is formed on the leg portion of the L-shaped main tool body unit wherein the leg portion is provided with a padded handle element and a lever element disposed intermediate the handle element and said bucking head member; and a pair of replaceable impact surface units removably mounted on the opposite ends of the main tool body unit wherein said pair of replaceable impact surface units includes a first generally U-shaped impact member dimensioned to be received on at least one of the opposite ends of said main tool body unit.

16. The bucking tool construction as in claim 15 further including a second generally C-shaped impact member dimensioned to be received on at least one of the opposite ends of said main tool body unit.

17. The bucking tool construction as in claim 16 wherein said first and second impact members include an impact plate.

18. The bucking tool construction as in claim 17 wherein said first impact member includes a pair of mounting panels disposed on opposite sides of said impact plate.

19. The bucking tool construction as in claim 17 wherein said second impact member includes a top mounting panel and a rear mounting panel.

20. The bucking tool as in claim 15 wherein said first impact member is provided with a lip portion dimensioned to engage the bucking head member.

21. The bucking tool as in claim 16 wherein said second impact member is provided with a lip portion dimensioned to engage the bucking foot member.

* * * * *